US007600452B2

(12) United States Patent
McDaniel

(10) Patent No.: US 7,600,452 B2
(45) Date of Patent: Oct. 13, 2009

(54) PNEUMATIC TAPPET ADJUSTMENT TOOL

(75) Inventor: Marc A. McDaniel, Botkins, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/693,860

(22) Filed: Mar. 30, 2007

(65) Prior Publication Data

US 2008/0236342 A1 Oct. 2, 2008

(51) Int. Cl.
*B25B 23/14* (2006.01)
*B25B 13/48* (2006.01)

(52) U.S. Cl. ..... 81/467; 81/9.24; 81/55

(58) Field of Classification Search ..... 81/467, 81/9.24, 55, 469, 472, 13, 473–476
See application file for complete search history.

(56) References Cited

U.S. PATENT DOCUMENTS

| | | | | |
|---|---|---|---|---|
| 1,654,319 | A * | 12/1927 | Brown | 81/9.24 |
| 2,736,220 | A * | 2/1956 | Kamuk | 81/55 |
| 3,323,394 | A * | 6/1967 | Bangerter et al. | 81/55 |
| 3,717,053 | A | 2/1973 | Sturges | |
| 4,088,197 | A | 5/1978 | Roll et al. | |
| 4,154,308 | A | 5/1979 | Goldsberry et al. | |
| 4,631,992 | A | 12/1986 | Eckman | |
| 4,712,456 | A | 12/1987 | Yuan | |
| 4,875,528 | A | 10/1989 | Thackston | |
| 4,880,064 | A | 11/1989 | Willoughby et al. | |
| 4,887,499 | A | 12/1989 | Kipfelsberger | |
| 5,005,682 | A | 4/1991 | Young et al. | |
| 5,356,350 | A | 10/1994 | Schreiber | |
| 5,490,439 | A | 2/1996 | Matsumura et al. | |
| 5,505,676 | A | 4/1996 | Bookshar | |
| 6,085,849 | A | 7/2000 | Scigliuto | |
| 6,176,162 | B1 | 1/2001 | Ludwig et al. | |
| 6,345,436 | B1 | 2/2002 | Codrington | |
| 6,450,072 | B1 | 9/2002 | Koester | |
| 6,725,943 | B2 | 4/2004 | Ginell | |

FOREIGN PATENT DOCUMENTS

| | | | |
|---|---|---|---|
| DE | 10 2004 009 494 | | 9/2005 |
| EP | 105655 | A1 * | 4/1984 |
| GB | 1 197 433 | | 7/1970 |
| JP | 2002-47907 | | 2/2002 |

* cited by examiner

*Primary Examiner*—Hadi Shakeri
(74) *Attorney, Agent, or Firm*—Rankin, Hill & Clark LLP; Vincent Ciamacco

(57) ABSTRACT

A tool for adjusting the tappet clearance in the valve actuation system of an internal combustion engine includes a screw adjustment portion that is driven by a pneumatic powered screw driver. The pneumatic power to the screw driver is regulated to cause the screw driver to position the screw so that the desired biasing force is present. The screw driver bit passes through the head portion of a torque limiting wrench which is used to loosen and tighten the jam nut that secures the tappet adjustment screw. The tool also has a pneumatic driven gripping mechanism to hold the screw driver bit in position and prevent inadvertent displacement of the tappet adjustment screw while the jam nut is tightened.

7 Claims, 4 Drawing Sheets

PNEUMATIC TAPPET ADJUSTMENT TOOL

BACKGROUND OF THE INVENTION

The present invention generally relates to the setting of tappet screws such as those used to adjust actuation of valves in internal combustion engines, and more particularly, to a tool for adjusting the tappet screw while engaging the jam nut that secures the tappet screw.

DESCRIPTION OF THE RELATED ART

The valve actuation system of internal combustion engines typically uses rocker arms to open the valves. One rocker arm is used in association with each valve. One end of each rocker arm engages a camshaft and the other end contacts the upper end of the valve stem to operate the valve. The rocker arm engages the valve stem to move it axially in opposition to a valve spring to open the valve. As the rocker arm moves away, the spring urges the valve to close again. Thus, as the cam shaft rotates the rocker arm moves back and forth opening the valve and allowing the valve to close.

The end of the rocker arm that engages the valve stem has a tappet adjustment screw or tappet that engages the valve stem. The tappet adjustment screw has a very fine thread pitch, so that it is capable of being precisely positioned relative to the end of the valve stem. The position of the tappet screw is secured by a jam nut located on the top end of the screw adjacent to the upper surface of the rocker arm. Tappet clearance is the distance between the bottom end of the tappet screw and an upper end of the valve. It is important that the clearance between the tappet and the valve stem be set correctly so that the valves will operate properly. Once the tappet clearance is set, the tappet nut is tightened against the rocker arm so that further rotation of the tappet adjustment screw is prevented. Typically, setting of the tappet clearance is one of the final steps in engine assembly, and is performed with the cylinder head installed on the cylinder block.

Various methods and devices for manually adjusting tappet screws are known in the art. When using such devices, it is a common practice for an assembler to walk along and manually adjust the tappet clearance as the engine travels on the assembly line. In accordance with one conventional method, the crankshaft or cam is put in the proper angular orientation, and feeler gauges are inserted between the camshaft and the rocker arm. The tappet screw then is rotated or adjusted toward the valve stem. This rotation of the tappet screw continues until the valve spring exhibits a biasing force of a predetermined value against the tappet screw. This method requires a device to turn the tappet screw, and this device is operated until the biasing force or load is such that no further rotation of the tappet screw should be made when the predetermined valve spring force is measured by the feeler gauge. Then a wrench is used to tighten the nut to hold the tappet screw in the precise desired position. A torque wrench is commonly used so that the nut is tightened to exactly the desired amount. This manual method requires positioning the feeler gauge, adjusting the tappet screw and then tightening the nut without disturbing the position of the tappet adjustment screw. It is often difficult to accomplish all of the actions precisely, and it is usually awkward to have all of the required tools in position simultaneously.

Various devices have been developed to facilitate the setting of the tappet clearance. For example, the tool in U.S. Pat. No. 6,345,436 provides for a combination of a member for rotating the screw toward or away from the valve, and means for measuring the force on the screw so that it may be positioned precisely. U.S. Pat. No. 6,450,072 discloses a tool in which the tappet screw is adjusted by a hand-operated device that does not apply more than a predetermined torque limit, with a torque wrench which is used to loosen and tighten the jam nut. The proper amount of torque is achieved by the use of a clutch mechanism. This tool requires the operator to have the proper feel for the appropriate amount of torque. The operator can override the torque setting by exceeding the designated number of clicks produced by the clutch mechanism, or by turning the tool too fast, or by applying excessive force to the handle, or by spinning the tool insufficiently to engage the clutch. If the proper torque is not applied to the screw, the clearance will be set incorrectly. In addition, the tool requires a repetitive motion that has ergonomic deficiencies.

While these devices may operate generally satisfactorily, they require some expertise to operate correctly. Setting the precise tappet clearance still requires operator skill, and the possibility of error is unreasonably high. Fully automatic devices are available, but they are bulky and difficult to handle. They are also expensive to purchase and maintain.

It is also difficult using existing machines to hold the tappet screw in precise position while the jam nut is being secured. If the tappet screw is moved from its set position while the nut is tightened, the tappet clearance will not be accurately set.

SUMMARY OF THE INVENTION

The present invention provides a unique tool for setting tappet clearance and a method for setting tappet clearance. In accordance with the present invention, the tappet screw can be accurately set to the desired clearance easily and accurately using a tool that is easy to handle and relatively easy to operate.

The tappet adjustment tool of the present includes both a torque wrench to loosen and tighten the jam nut and a screw driver extending through the socket of the torque wrench for positioning the tappet screw at the desired setting when the jam nut is loosened, and both of the screw driver and the torque wrench are provided in a single tool, so that the tappet screw and the jam nut can be engaged simultaneously.

The screw driver in the tappet adjustment tool of the present invention is pneumatically powered with an air motor that includes a spring clutch mechanism designed to shut the tool down at a predetermined desired torque. This allows the tappet screw to be rotated and adjusted into position until the desired opposing force of the valve spring is such that the screw is at exactly the desired setting. The setting of the tappet screw is performed automatically, without need for expertise of an operator who has the proper feel for the appropriate amount of torque. It also minimizes the possibilities that the operator can override the torque setting by turning the tappet screw too far or not far enough.

To assure that the setting of the tappet screw is not disturbed while the jam nut is tightened, the tappet adjustment tool of the present invention includes a gripping mechanism that holds the screw driver bit in the exact position at which it stopped. The gripping mechanism is automatically actuated when the screw driver is disengaged, ensuring that the tappet screw will not move, and allowing the jam nut to be tightened by the torque wrench portion of the tool without disturbing the setting of the tappet screw.

The tappet adjustment tool of the present invention has an ergonomic design which allows it to be easily handled by the operator with the screw driver portion in one hand the handle of the torque screw portion in the other hand, and permits both portions to be comfortably operated in a repetitive fashion.

These and other advantages are provided by the present invention of a tool for adjusting the position of a threaded tappet screw relative to a spring biased valve, the tappet screw being selectively locked in position by engagement of a jam nut on the screw. The tool comprises a wrench portion having a socket adapted to engage the jam nut, a handle for turning the socket, and a clutch mechanism to prevent further turning of the socket by the handle when the socket encounters a predetermined torque level. The tool also comprises a bit extending through the socket. The bit is engageable with the tappet screw for rotating the tappet screw toward or away from the valve. The tool further comprises a powered rotational driver attached to the bit to turn the bit and move the tappet screw toward and away from the valve stem. The rotation of the screw driver stops when it encounters a predetermine torque has been encountered.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

The invention will now be described in accordance with its preferred embodiments. The description with reference to the figures is intended to simplify the explanation of the invention and is not meant to limit the scope of the invention.

Figure 1:
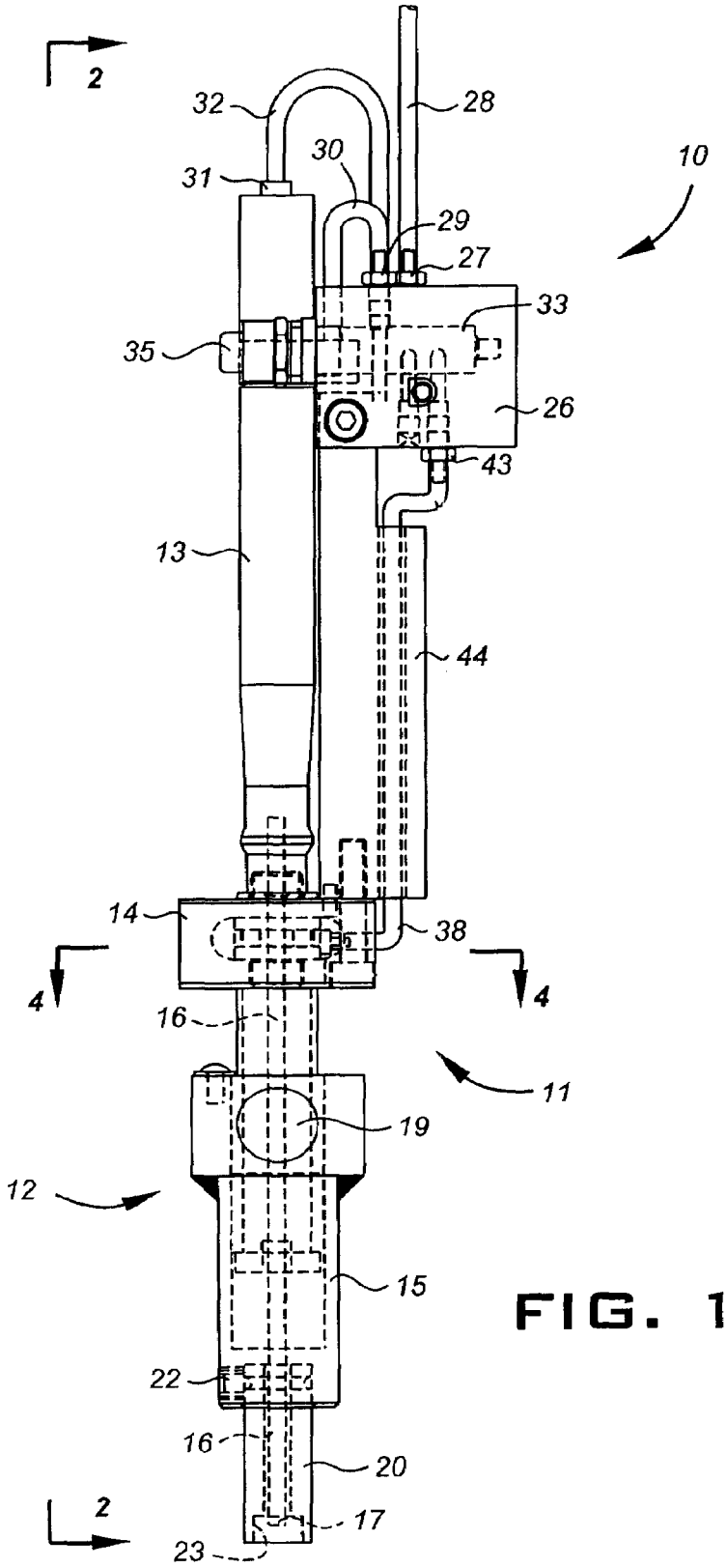
FIG. 1 is a side elevational view of the tappet adjustment tool of the present invention.
Figure 2:
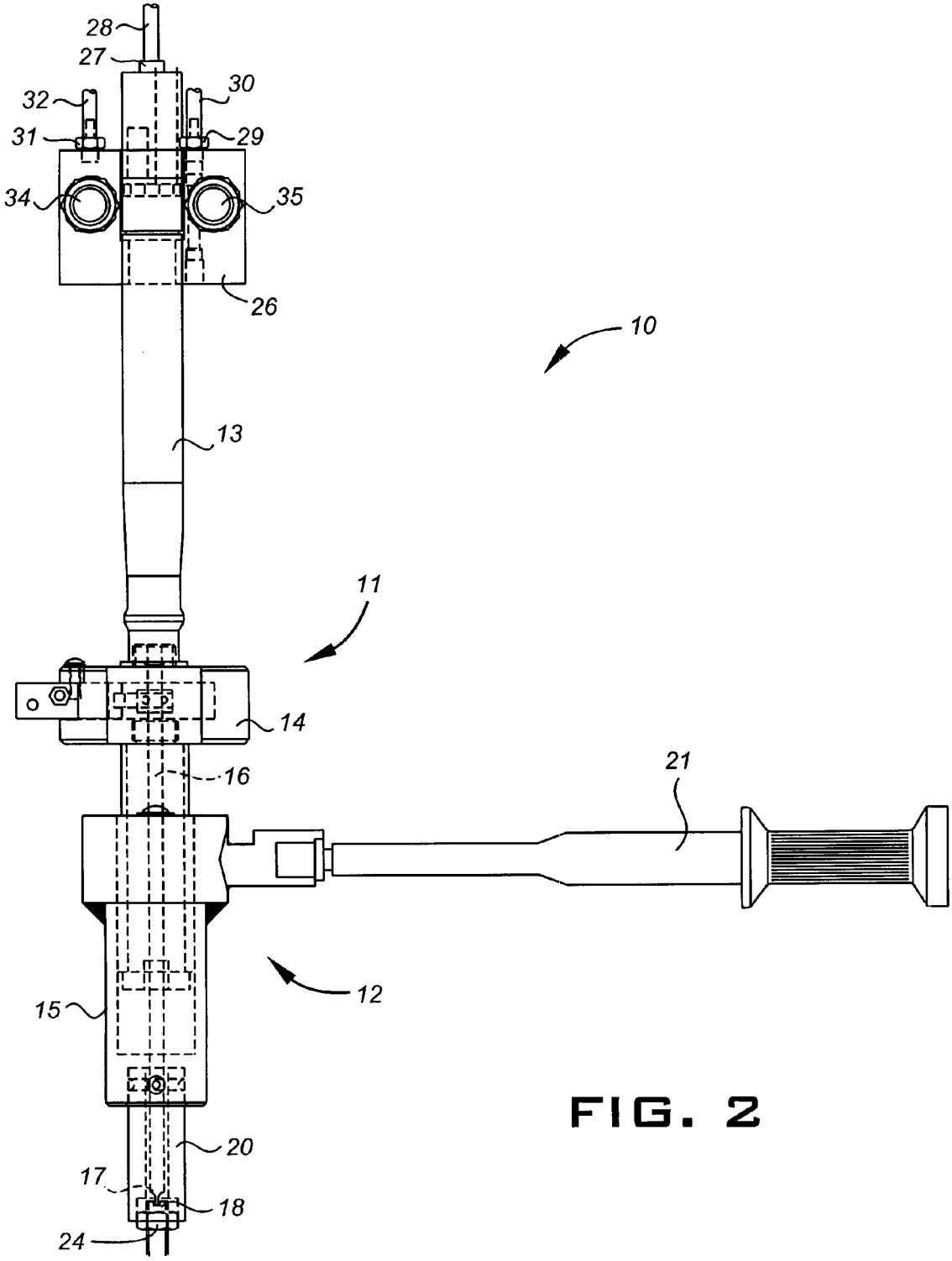
FIG. 2 is a side elevational view taken along line 2-2 of FIG. 1, with the socket shown in a lower position.
Figure 3:
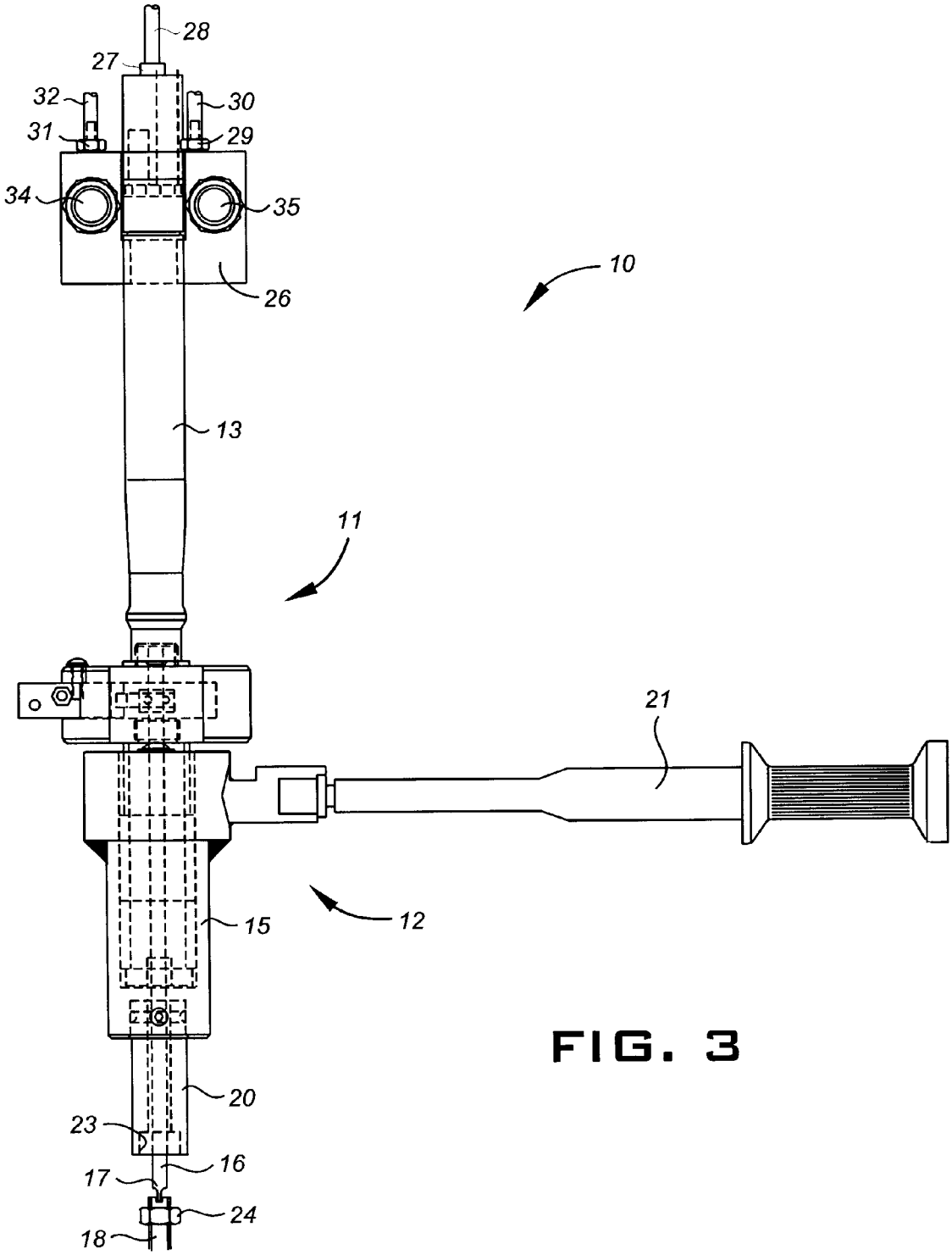
FIG. 3 is a side elevational view similar to FIG. 2, with the socket shown in an upper position.

With reference to FIGS. 1-3, a tappet adjustment tool 10 is shown. The tool includes a screw adjustment portion 11 for positioning the tappet adjustment screw and jam nut engaging portion 12 for tightening and loosening the jam nut to prevent or allow positioning of the tappet adjustment screw.

The screw adjusting portion includes a pneumatically powered screw driver 13 mounted on the top of a base 14. The screw driver 13 has an air motor with a spring clutch mechanism designed to shut the tool down at a predetermined desired torque. Extending from the bottom of the base is a hollow elongated sleeve 15. An elongated bit 16 is attached to the drive of the screw driver 13. The bit 16 extends through the sleeve 15. The bottom of the bit 16 is provided with a flat screw engaging end 17 for engaging a slot formed in the top of the tappet adjustment screw 18 (FIG. 3).

A jam nut engaging portion 12 generally resembles a torque wrench, and comprises a head 19 which fits over the sleeve 15, a socket 20 that is attached to the bottom end of the head, and a handle 21 attached to the top of the socket. The socket 20 is attached to the bottom of the head by a set screw 22. The bottom of the socket 20 has a hex wrench opening 23 designed to engage the jam nut 24. The head 19 is longitudinally slidable along the sleeve 15, so that the head may be moved upwardly as shown in FIG. 3 to facilitate the placement of the drive bit 16 on the screw 18, and then moved downwardly to the position shown in FIG. 2 so that the socket 20 engages the jam nut 24. A cylindrical PTFE bushing 25 is preferably positioned between the outside of the sleeve 15 and the inside of the head 19 to facilitate movement of the head along the sleeve.

The head 19 of the jam nut engaging portion is located coaxially with the bit 16 on the screw driver such that the bit extends through the wrench socket 20 without interference, and thereby allows for forward and reverse rotation of the bit to adjust the position of the tappet screw 18 upwards or downwards to precisely the exact desired position.

A control box 26 is mounted on the upper end of the screw driver 13. The control box 26 includes a fitting 27 for connection to a line 28 supplying pneumatic pressure to the tool. It also includes a fitting 29 for connection to a line 30 supplying pneumatic pressure to drive the screw driver 13 in the forward direction, and a fitting 31 for connection to a line 32 supplying pneumatic pressure to drive the screw driver 13 in the reverse direction. Inside the control box 26 is a three-way stem valve 33 to control the pneumatic pressure supplied to the screw driver 13.

As shown in FIG. 2, two control pushbuttons 34 and 35 extend from control box 26. The first control pushbutton 34 is connected to the valve 33 in the control box 26 to actuate the valve to supply pneumatic pressure to drive the screw driver 13 in the forward direction. When the control pushbutton 34 is actuated, it moves the valve 33 to connect the line 30 to the pneumatic supply line 28, causing the screw driver 13 to turn in the forward direction or clockwise when viewed from above, so that the tappet adjustment screw 18 is driven downwardly. The second control pushbutton 35 is connected to actuate the valve 33 in the control box 26 to cause the valve supply pneumatic pressure to drive the screw driver 13 in the reverse direction. When the control pushbutton 35 is actuated, it moves the valve 33 to connect the line 32 to the pneumatic supply line 28, causing the screw driver 13 to turn in the reverse direction or counter clockwise when viewed from above, so that the tappet adjustment screw 18 is moved upwardly. Preferably, the control pushbuttons 34 and 35 are differently colored; for example, the forward pushbutton 34 is colored green, and the reverse pushbutton 35 is colored red.

Figure 4:
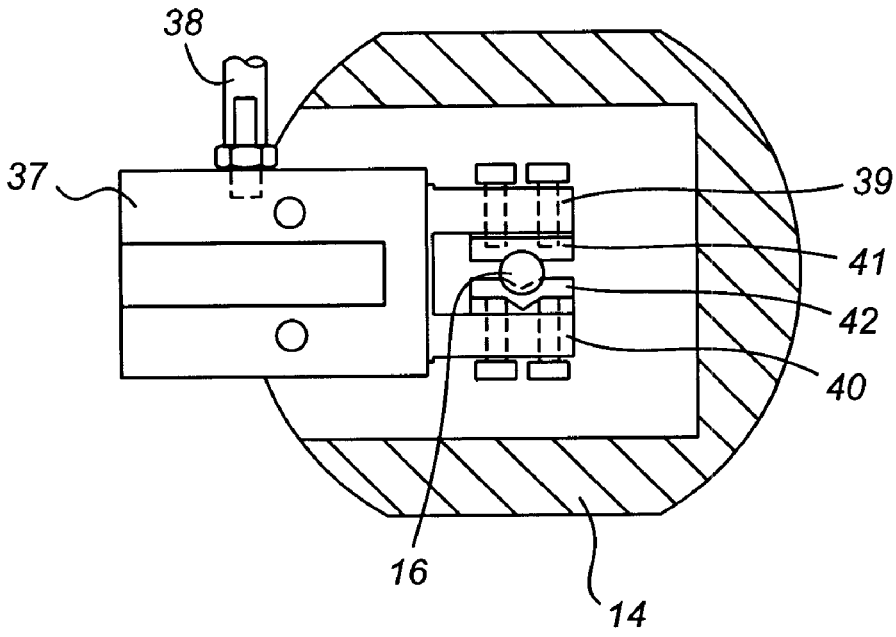
FIG. 4 is a cross sectional view taken along line 4-4 of FIG. 1 showing a gripper mechanism in an activated or gripping position.
Figure 5:
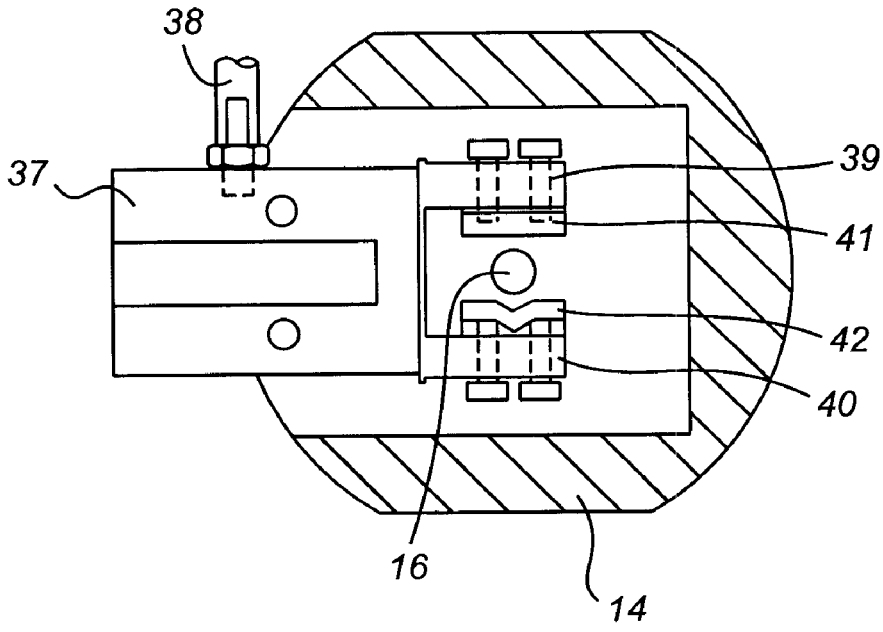
FIG. 5 is a view similar to FIG. 4, but showing the gripper mechanism in a deactivated or non-gripping position.

The adjuster drive bit 16 is held in position during the tightening of the jam nut 24 by means of a gripper mechanism 36. With reference to FIG. 4, the gripper mechanism 36 comprises a pneumatically operated parallel gripper actuator 37 mounted within the base 14. The actuator 37 is connected to a pneumatic line 38, and is spring biased to the open position. The actuator 37 is operative to close when it receives pneumatic pressure, and to open when there is no pressure. A pair of gripper fingers 39 and 40 extends from the actuator 37 on each side of the bit 16. A finger extension 41 and 42 is mounted on each of the gripper fingers 39 and 40, and each of the finger extensions is configured to provide maximum contact with the exterior periphery of the bit 16.

The pneumatic line 38 from the gripper mechanism 36 is connected though a fitting 43 on the control box 26 to the control valve 33. The valve 33 is arranged so that when neither of the control pushbuttons 34 or 35 is actuated and the valve is in its resting position, pneumatic pressure is supplied through the line 38 to the gripper mechanism 36 to close the gripper fingers 39 and 40 and hold the screw driver bit 16 securely in its present position. When either of the control pushbuttons 34 or 35 is actuated to move the position of the valve 33 and supply pneumatic pressure to the screw driver 13 to turn the screw driver bit 16 in either direction, pneumatic pressure to the gripper mechanism 36 is cut off, and the gripper fingers 39 and 40 open to allow the screw driver bit to rotate.

Thus, when the tappet adjustment screw 18 is set in the precise desired position, pneumatic pressure is supplied by the line 38 to the actuator 37 to close the fingers 39 and 40 together and hold the bit 16 in the exact position where the bit is holding the tappet adjustment screw at the desired setting. While the gripper mechanism 36 holds the bit 16, the jam nut engaging portion 12 can be used to tighten the jam nut 24 to secure the screw 18 in this position.

The pneumatic line 38 from the gripper mechanism 36 extends alongside the screw driver 13 from the gripper mechanism to the control box 26. The line 38 is protected by a sleeve 44 which extends parallel to the screw driver 13. The exterior of the screw driver 13 and the sleeve 44 together provide a means by which the tool may be easily gripped by the operator.

In the operation of the tappet adjustment tool 10 of the present invention, the operator locates the tappet jam nut 24, and positions to tool on the nut such that the socket 20 engages the nut. The operator then places shim stock, the size of the shim stock dependent on the desired gap, between the valve stem and the distal end of the tappet adjustment screw. Holding the screw driver portion of the tool in the left hand, the operator uses the right hand on the handle 21 to turn the socket 20 and loosen the jam nut. This allows the tappet adjustment screw 18 to turn freely. The operator then triggers forward movement of the pneumatic powered screw driver 13 by actuating the control pushbutton 34. The screw driver 13 runs until it encounters the torque shutoff point, indicating that the tappet adjustment screw 18 is at precisely the right setting for the desired tappet clearance. When this occurs the regulated pneumatic pressure supplied to the screw driver 13 will be insufficient to driver the screw driver further, and the screw driver will stop in the desired position. The operator then releases the control pushbutton 34 which actuates the gripper mechanism 36 to clamp down on the driver bit 16, and the screw driver 13 is turned off. The operator then uses the handle 21 to turn the socket 20 and manually lock the jam nut 24 in place while holding the tool by griping the screw driver portion. The clutch mechanism in the wrench 12 will limit the amount of torque that is applied to the jam nut, so that the jam nut is tightened to the proper tightness. The tool is removed from the jam nut, and the tappet clearance is set.

If it is necessary to back up the tappet screw to re-set it, the tool 10 can be re-positioned as before, and, with the jam nut loosened, the operator actuates the other control pushbutton 35 to reversely drive the screw driver 13 and cause the tappet screw 18 to move into position where it can be re-set using the above procedure.

While the present invention has been described with particularity herein, it is considered apparent that the present invention is capable of numerous modifications, substitutions, and rearrangements of parts without departing from the scope and spirit of the present invention. Therefore, the invention is not to be limited to the particular preferred embodiments described hereinbefore, but rather only defined by the claims appended hereto.

What is claimed is:

1. A tool for adjusting the position of a threaded tappet screw relative to a spring biased valve, the tappet screw being selectively locked in position by engagement of a jam nut on the screw, wherein the tool comprises:

a wrench portion having a socket adapted to engage the jam nut, a handle for turning the socket, and a clutch mechanism to prevent further turning of the socket by the handle when the socket encounters a predetermined torque level;

a bit extending through the socket, the bit engageable with the tappet screw for rotating the tappet screw towards or away from the valve;

a powered rotational driver attached to the bit to turn the bit for moving the screw toward and away from the valve, the driver stopping rotation when it encounters a predetermined torque level; and, a gripper mechanism including a parallel gripper actuator having a pair of gripper fingers, wherein said gripper mechanism is selectively activated and deactivated so as to either grip said bit, and thereby prevent rotation of said bit, or to release said bit and thereby permit rotation of said bit, wherein said gripper mechanism is adapted to prevent rotation of said bit at any rotational position of said bit, and wherein said gripper mechanism is deactivated to release said bit upon power-operation of said powered rotational driver and activated to grip said bit when said powered rotational driver is stopped.

2. A tool for adjusting the position of a threaded tappet screw relative to a spring biased valve, the tappet screw being selectively locked in position by engagement of a jam nut on the screw, wherein the tool comprises:

a wrench portion having a socket adapted to engage the jam nut, a handle for turning the socket, and a clutch mechanism to prevent further turning of the socket by the handle when the socket encounters a predetermined torque level;

a bit extending through the socket, the bit engageable with the tappet screw for rotating the tappet screw towards or away from the valve; and a powered rotational driver attached to the bit to turn the bit for moving the screw toward and away from the valve, the driver stopping rotation when it encounters a predetermined torque level, a gripper mechanism including a parallel gripper actuator having a pair of gripper fingers, wherein said gripper mechanism is selectively activated and deactivated so as to either grip said bit, and thereby prevent rotation of said bit, or to release said bit and thereby permit rotation of said bit, wherein said gripper mechanism is adapted to automatically deactivate upon power-operation of said powered rotational driver and automatically activate when said powered rotational driver is not being driven, and wherein the gripper mechanism is pneumatically powered.

3. The tool of claim 2, wherein the powered rotational driver is a pneumatically powered screw driver.

4. The tool of claim 3, further comprising a multiple position valve, wherein said valve is adapted to supply pressurized air to either said powered rotational driver or to said gripper mechanism.

5. A method for adjusting a position of a threaded tappet screw relative to a spring biased valve, the tappet screw being selectively locked in position by engagement of a jam nut on the screw, comprising the steps of:

providing a tool, comprising:

a wrench portion having a socket adapted to engage the jam nut, a handle for turning the socket, and a clutch mechanism to prevent further turning of the socket by the handle when the socket encounters a first predetermined torque;

a bit extending through the socket, the bit engageable with the tappet screw for rotating the tappet screw toward and away from the valve;

a powered rotational driver attached to the bit to turn the bit for moving the screw toward and away from the valve, the driver stopping rotation when it encounters a second predetermined torque; and, a gripper mechanism including a parallel gripper actuator having a pair of gripper fingers, wherein said gripper mechanism is selectively activated and deactivated so as to either grip said bit, and thereby prevent rotation of said bit, or to release said bit and thereby permit rotation of said bit, wherein said gripper mechanism is adapted to prevent rotation of said bit at any rotational position of said bit and to automatically deactivate upon power-operation of said powered rotational driver and to automatically activate when said powered rotational driver is not being driven;

engaging said bit with said tappet screw;

operating said powered rotational driver to move said tappet screw toward the valve;

discontinuing operation of said powered rotational driver when the second predetermined torque is experienced, activating said gripper mechanism to hold said bit at a rotational position of said bit when the second predetermined torque was experienced; and, tightening said jam nut with said wrench portion until said first predetermined torque is experienced.

6. The method of claim 5, wherein said tool is pneumatically operated, wherein the gripper mechanism is a pneumatic gripper mechanism and the powered rotational driver is a pneumatic powered rotational driver, and wherein said tool includes a multiple position valve, wherein said multiple position valve is adapted to supply pressurized air to either said pneumatic powered rotational driver or to said pneumatic gripper mechanism, and wherein supply of pressurized air is automatically switched from said pneumatic powered rotational driver to said pneumatic gripper mechanism when said second predetermined torque is experienced so as to activate said pneumatic gripper mechanism.

7. The method of claim 6, wherein said operating step includes the further step of deactivating said gripper mechanism.

* * * * *